US006360406B1

(12) United States Patent
Patterson et al.

(10) Patent No.: US 6,360,406 B1
(45) Date of Patent: Mar. 26, 2002

(54) CANTILEVER LATCH MECHANISM

(75) Inventors: Gregory S. Patterson, Morrisville; John Thomas Sadler, Wake Forest; Jason D. Mareno, Raleigh, all of NC (US)

(73) Assignee: Ericsson Inc., RTP, NC (US)

( * ) Notice: Subject to any disclaimer, the term of this patent is extended or adjusted under 35 U.S.C. 154(b) by 0 days.

(21) Appl. No.: 09/528,642

(22) Filed: Mar. 20, 2000

(51) Int. Cl.[7] ..... A44B 11/25; H01R 13/00

(52) U.S. Cl. ..... 24/457; 24/453; 24/458; 24/618; 439/357

(58) Field of Search ..... 24/459, 297, 618, 24/453, 563, 3.11; 439/357

(56) References Cited

U.S. PATENT DOCUMENTS

| | | | | | |
|---|---|---|---|---|---|
| 2,137,210 | A | * | 11/1938 | Lombard | 24/453 |
| 2,548,838 | A | * | 4/1951 | Gillespie | 24/453 |
| 3,345,706 | A | * | 10/1967 | Stokes | 24/458 |
| 3,705,442 | A | * | 12/1972 | Sygnator | 24/459 |
| 4,576,535 | A | * | 3/1986 | Howering | 24/453 |
| 4,861,208 | A | * | 8/1989 | Boundy | 411/339 |
| 5,065,490 | A | * | 11/1991 | Wivagg et al. | 29/402.17 |
| 5,189,766 | A | * | 3/1993 | Weber | 24/459 |
| 5,848,456 | A | | 12/1998 | Sjoqvist | |
| 6,101,686 | A | * | 8/2000 | Velthoven et al. | 24/297 |

FOREIGN PATENT DOCUMENTS

| | | | | |
|---|---|---|---|---|
| FR | 1052517 | * | 1/1954 | 24/618 |
| FR | 2.012.756 | | 3/1970 | |
| GB | 0921674 | * | 3/1963 | 24/297 |
| GB | 2338124 A | | 12/1999 | |

* cited by examiner

*Primary Examiner*—Victor N. Sakran
(74) *Attorney, Agent, or Firm*—Coats & Bennett, P.L.L.C.

(57) ABSTRACT

A cantilever latch mechanism includes a base and a pair of arms extending from the base. The arms are spaced a distanced apart and selectively positionable between an open orientation wherein an opening is formed between the arms, and a closed orientation where the arms are positioned in a closer relation. Each of the arms may include a jaw extending inwardly into the opening. Preferably, the jaws are positioned on different vertical planes on each arm such that they overlap when the arms are in the closed orientation.

4 Claims, 5 Drawing Sheets

CANTILEVER LATCH MECHANISM

FIELD OF THE INVENTION

The present invention relates generally to a latch mechanism and, more particularly, to a passive lock latch mechanism having two cantilever arms extending from a common base.

BACKGROUND OF THE INVENTION

In the telecommunications industry, products continually are getting smaller to meet the demands of consumers. Small product sizes are a valuable attribute because they are easier for the user to handle and more convenient to store when not in use, such as within a briefcase, purse, etc. As a result of the smaller sizes, stronger designs and innovative solutions are necessary for the products to ensure that they do not break or otherwise become damaged in being handled by the consumers. One particularly difficult area is latch mechanisms for securing power and/or communications connectors to wireless communications mobile terminals. Such latching mechanisms should provide sufficient mechanical strength to keep the connector attached while being subject to the physical size restraints of smaller product sizes.

Latch designs for connectors typically take either a positive locking approach or a passive locking approach. A positive latching approach requires that the user manually press some portion of the connector mechanism to disengage the latch. In contrast, a passive latching approach allows the user to simply pull on the connector to disengage the latch mechanism. While positive locking approaches tend to be more expensive and consume more space, passive locking schemes are somewhat more prone to failure. While a number of passive locking mechanisms have been proposed, these mechanisms have not proven adequate for all applications, particularly for the small connectors commonly used with wireless communications mobile terminals.

Therefore, there is a need for a passive latch mechanism for connectors that provides the mechanical strength required to maintain the mechanism within the corresponding receptacle and still be sized to fit within the physical restraints of the smaller product sizes.

SUMMARY OF THE INVENTION

The latch mechanism includes two opposing arms that are deformable between an open, spaced-apart orientation and a closed position in which the arms are touching or in proximate relationship to each other. The mechanism returns to the open position when no external forces are applied. When in the open position, the arms provide a spring-like expansion force that opposes deformation into the closed position. Thus, when inserted within a receptacle and deformed towards the closed position, the spring force urges the arms back towards the open position. Upon full insertion, the arms of most embodiments spring outwardly, forcing retention barbs located near the insertion end of the arms outward against a retaining wall in the receptacle, thereby holding the latch mechanism, and thus the connector, in place. Preferably, upon complete insertion into the receptacle, the arms rapidly expand to the open position resulting in an audible "snap" which is heard by the user.

In one embodiment of the present invention, the latch mechanism includes an external end having a unitary base, and an insertion end having cantilever arms extending from the base. The arms are selectively positionable between open and closed orientations with an opening extending between the arms in the open orientation. Each of the arms further includes retention barbs extending outward and positioned away from the external end. The arms are preferably positioned such that they are disposed generally parallel to one another so as to form a generally U-shaped body with the base in the open configuration.

In some embodiments, the arms may include jaws extending inward from each of the arms. The jaws are positioned on different vertical planes such that they overlap when the arms are in the closed orientation. When the arms are in the open orientation, a channel opening is spaced between the jaws which leads into the opening. The channel opening is closed by the overlapping jaws when the arms are in the closed orientation.

The claimed cantilever latch mechanism allows for successful passive latching while providing a robust structure less prone to failure.

DETAILED DESCRIPTION OF THE INVENTION

Figure 1:
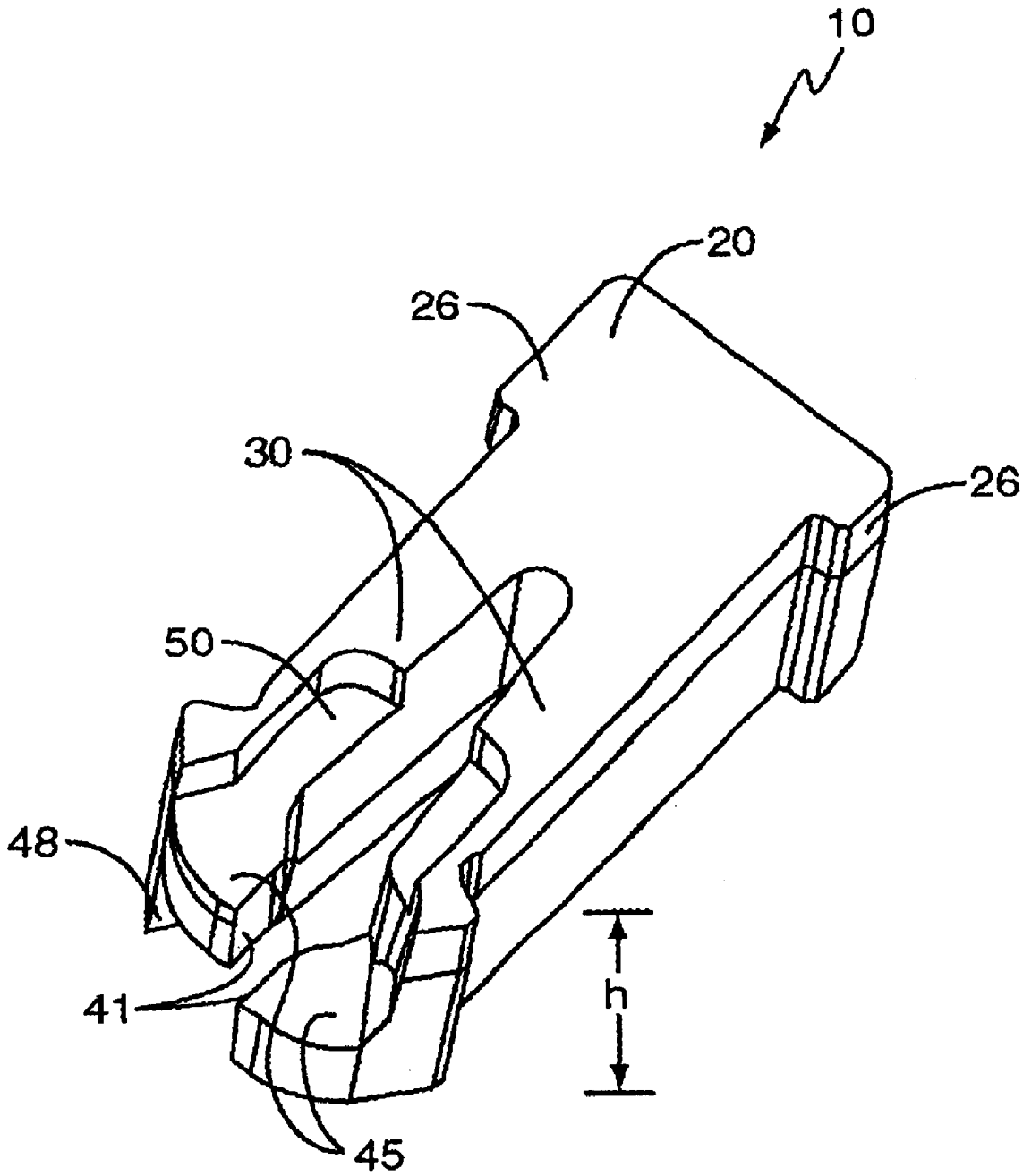
FIG. 1 perspective view of one embodiment of a latch mechanism constructed in accordance with the present invention.

Referring now to the drawings in general and FIG. 1 in particular, it will be understood that the illustrations are for the purpose of describing a preferred embodiment of the invention and are not intended to limit the invention thereto. As best illustrated in FIG. 1, the cantilever latch mechanism, generally designated 10, is shown constructed according to the present invention. The latch mechanism 10 includes a base 20 from which two cantilever arms 30 extend. The latch mechanism 10 mounts within a connector 90 from which the arms 30 extend for mating with a receptacle 100. The latch mechanism 10 may be a substitute for the device of U.S. Pat. No. 5,848,456, which is incorporated herein by reference.

Figure 2:
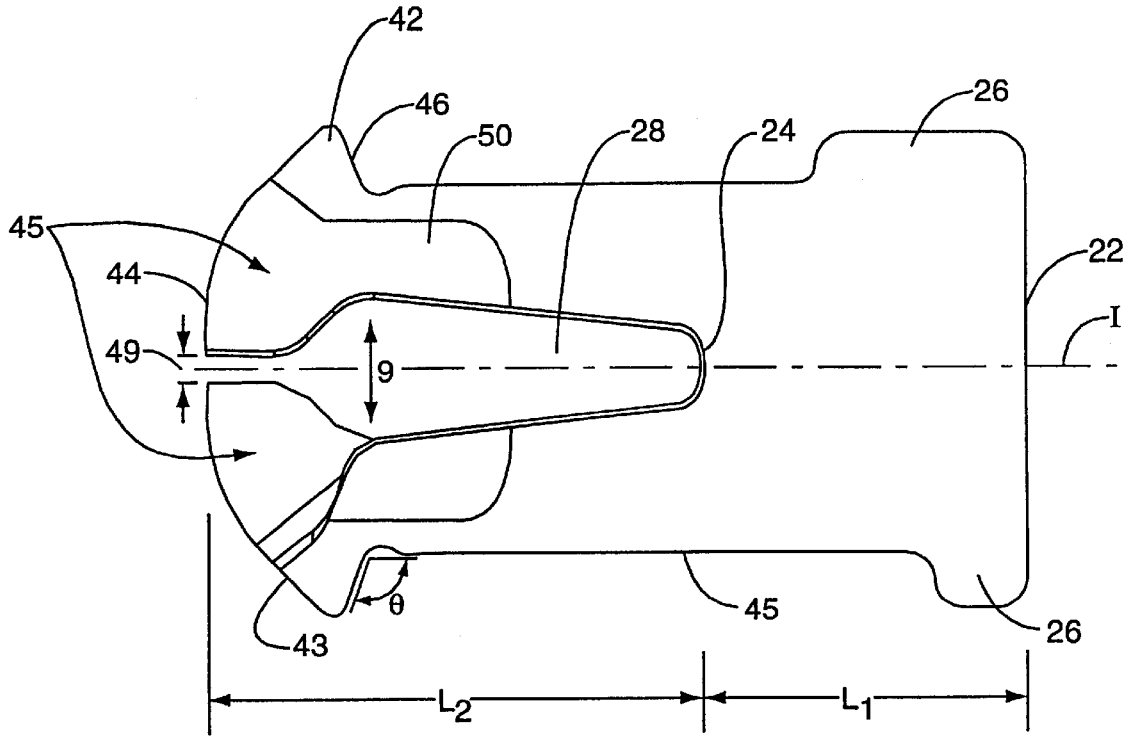
FIG. 2 is a top view of the latch mechanism illustrated in FIG. 1.

The first end of the latch mechanism 10 includes a base 20 as illustrated in FIG. 2 that extends from a tail 22 to a mediate portion 24 and having a length $L_1$. Feet 26 may extend from the base 20 and function as keys to properly orient the mechanism 10 within the connector 90. The specific configuration of the feet 26 may vary depending upon the specific demands of the latch mechanism 10 and connector 90.

The arms 30 extend from the base 20 and, at least in the open position, are spaced a distance apart forming an opening 28 therebetween. Arms 30 extend between the base 20 and an insertion edge 44 and have a length as illustrated by $L_2$ in FIG. 2. Retention barbs 42 extend outward from each arm 30 for contacting the receptacle 100 during insertion and maintaining the latch mechanism 10 in an attached position as will be discussed in more detail below. A retraction angle e is formed between a retention barb edge 46 and the insertion axis I. The retraction angle may vary depending upon the desired amount of force required to remove the mechanism 10 from the receptacle 100, such as between 100° and 130°. In one embodiment, the retraction angle is approximately 117°.

In the embodiment shown in FIG. 1, a jaw 45 extends inward from each arm 30 positioned near the insertion end and opposite the base 20. The jaws 45 extend inward towards the opening 28, and help define a channel entry 49 as illustrated in FIG. 2. Preferably, the channel entry 49 is small to shield the latch mechanism 10 from being incorrectly positioned within the receptacle 100 and from otherwise accidentally catching on objects. The jaws 42 include an angled lead-in edge 43 that extends into an insertion edge 44. The lead-in angle between the lead-in edge 43 and a line normal to the insertion axis I may vary depending upon the specific circumstances in which the latch mechanism 10 will be used. In one embodiment, the lead-in angle is about 30°. Preferably, the insertion edges 44 of the jaws 45 are also angled, but at a shallower angle, to also aid in deflecting objects and preventing them from inadvertently entering into the opening 28 via the channel entry 49.

As best illustrated in FIG. 1, the jaws 45 are preferably offset and located on different vertical planes to allow for the arms 30 be moved between open and closed orientations. In the closed orientation (e.g., with the arms 30 pressed together) the jaws 45 of the FIG. 1 embodiment overlap, thereby eliminating the channel entry 49. The range of motion of the arms 30 may vary depending on the desired outcome, and may deflect to a maximum extent such that each of the jaw edges 41 contacts the opposing arm edge 48. In the open orientation, the jaws 45 may be spaced a distance apart, or the jaws 45 may overlap in the open position such that there is no channel entry 49.

The arms 30 may have an asymmetrical outer shape or so called key shape in order to prevent insertion in the wrong position in the receptacle 100 which is correspondingly asymmetrically profiled. The asymmetrical profiling is achieved by a substantially right-angle keyway 50 positioned on one or both sides of the arms 30 as illustrated in FIG. 1. Thus, the proper alignment of the latch mechanism 10 within the connector 90 may be aided by the feet 26 and the height h, while the proper alignment of the latch mechanism 10 in the receptacle 100 may be aided by the presence of the keyway 50.

The latch mechanism 10 should be constructed of a rigid or semi-rigid elastic polymer material that is deformable so as to allow for the arms 30 to be selectively positionable between the open and closed orientations. In one embodiment, the mechanism 10 is constructed of materials including Stanyl TW341, and Ultem 1110F. The latch mechanism 10 normally assumes the open orientation when no external forces are applied. The resiliency of the material when the cantilevered arms 30 are deformed from the open orientation creates the spring force illustrated by arrow 9 in FIG. 2. When the arms 30 are deformed from the open orientation, the spring force urges the arms 30 towards the open position and helps maintain the latch mechanism 10 in attachment with the receptacle 100. The amount of spring force may be affected by the material of the latch mechanism 10, or the length of the arms 30. In one embodiment, the spring force is at least about 35 Newtons.

Figure 3A:
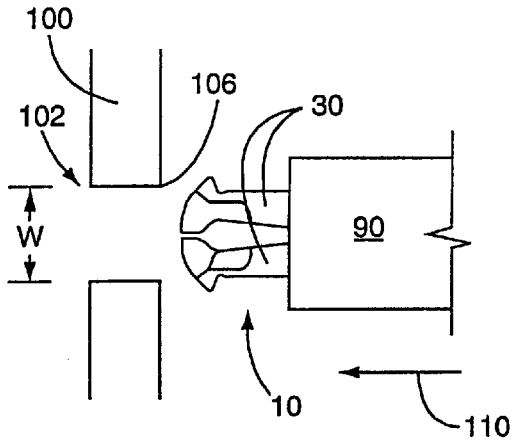
FIG. 3A is a side view illustrating the latch mechanism in the open orientation prior to insertion into a receptacle.
Figure 4A:
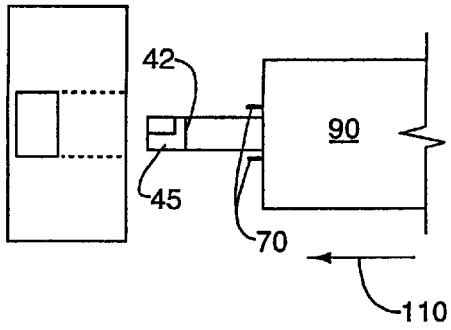
FIG. 4A is a top view of the latch mechanism illustrated in FIG. 3A.

FIGS. 3A–3C, and 4A–4C illustrate the insertion process of the latch mechanism 10 into the receptacle 100. Within this embodiment, the latch mechanism 10 has already been mounted within the connector 90 such that the arms 30 extend outward from the connector 90. FIGS. 3A and 4A illustrate the latch mechanism 10 being aligned with a receptacle opening 102 in the receptacle 100 such that the lead-in edge 43 is positioned near a receptacle front edge 106 to guide the mechanism 10 into the opening. The width of the opening W is less than the width of the retention arms in the open position such that an insertion force into the receptacle illustrated by arrow 110 is necessary for inserting the mechanism 10. As illustrated in FIG. 4A, electrical leads 70 may extend from the connector 90.

Figure 3B:
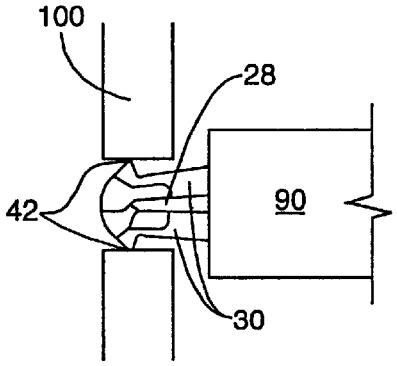
FIG. 3B is a side view illustrating the latch mechanism in the closed orientation during insertion into the receptacle.
Figure 4B:
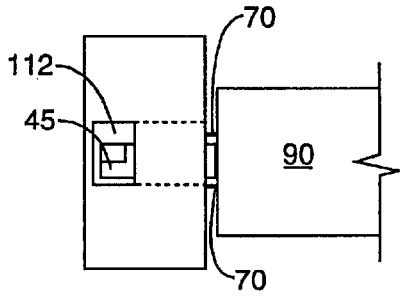
FIG. 4B is a top view of the latch mechanism illustrated in FIG. 3B.

FIGS. 3B and 4B illustrate the connector 90 with latch mechanism 10 partially inserted into the receptacle 100. The retention barbs 42 contact the receptacle edges as the mechanism 100 slides through the opening 102. The opening 28 is reduced as the arms 30 are pinched together to fit within the receptacle opening 102 and the channel entry 49 is eliminated. While it is typical for both arms 30*a*, 30*b* to flex during insertion, it may be that one of the arms 30 remains stationary as the latch mechanism 10 is moved between the open and closed orientations. FIG. 4B illustrates the edge of the jaws 45 extending partly through the receptacle 100 and through aperture 112 within the receptacle.

Figure 3C:
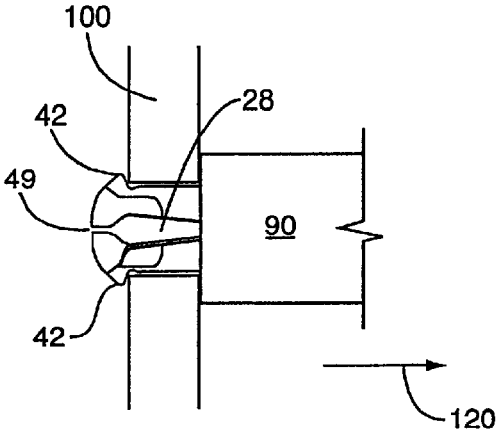
FIG. 3C is a side view illustrating the latch mechanism in the open orientation after passing through the receptacle.
Figure 4C:
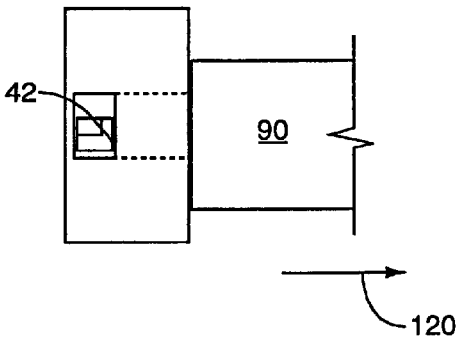
FIG. 4C is a top view of the latch mechanism illustrated in FIG. 3C.

FIGS. 3C and 4C illustrate the connector 90 with latch mechanism 10 fully inserted into receptacle 100. The arms 30 extend through the opening 102 such that the retention barbs 42 extend beyond the receptacle edges (retention wall) 106. The arms 30 expand apart to the open orientation such that the opening 28 is increased, reforming the channel entry 49. Alternatively, the width W of the opening 102 may be less than the width of the arms 30*a*, 30*b* in the open orientation, therefore the arms 30 are positioned between the open and closed orientations. The spring force of the arms 30 illustrated by arrow 9 in FIG. 2 maintains the mechanism 10 within the opening 102. Upon full insertion, preferably an audible "snap" as well as a positive seating of the connector 90 into position occurs when the retention barbs 42 extend beyond the receptacle 102 and the arms 30 expand to contact the opening edges. As illustrated in FIG. 4C, the connector neck 90 contacts the receptacle 100 and the electrical leads 70 are firmly connected with their counterparts on the receptacle 100.

Removal of the connector 90 and latch mechanism 10 is obtained in a passive manner by pulling the connector 90, and therefore the associated latch mechanism 10, away from the receptacle 100 in the direction illustrated by arrow 120 in FIGS. 3C and 4C. It is not necessary to grasp or otherwise pinch the arms 30 to remove the latch mechanism 10 for removal.

Figure 5:
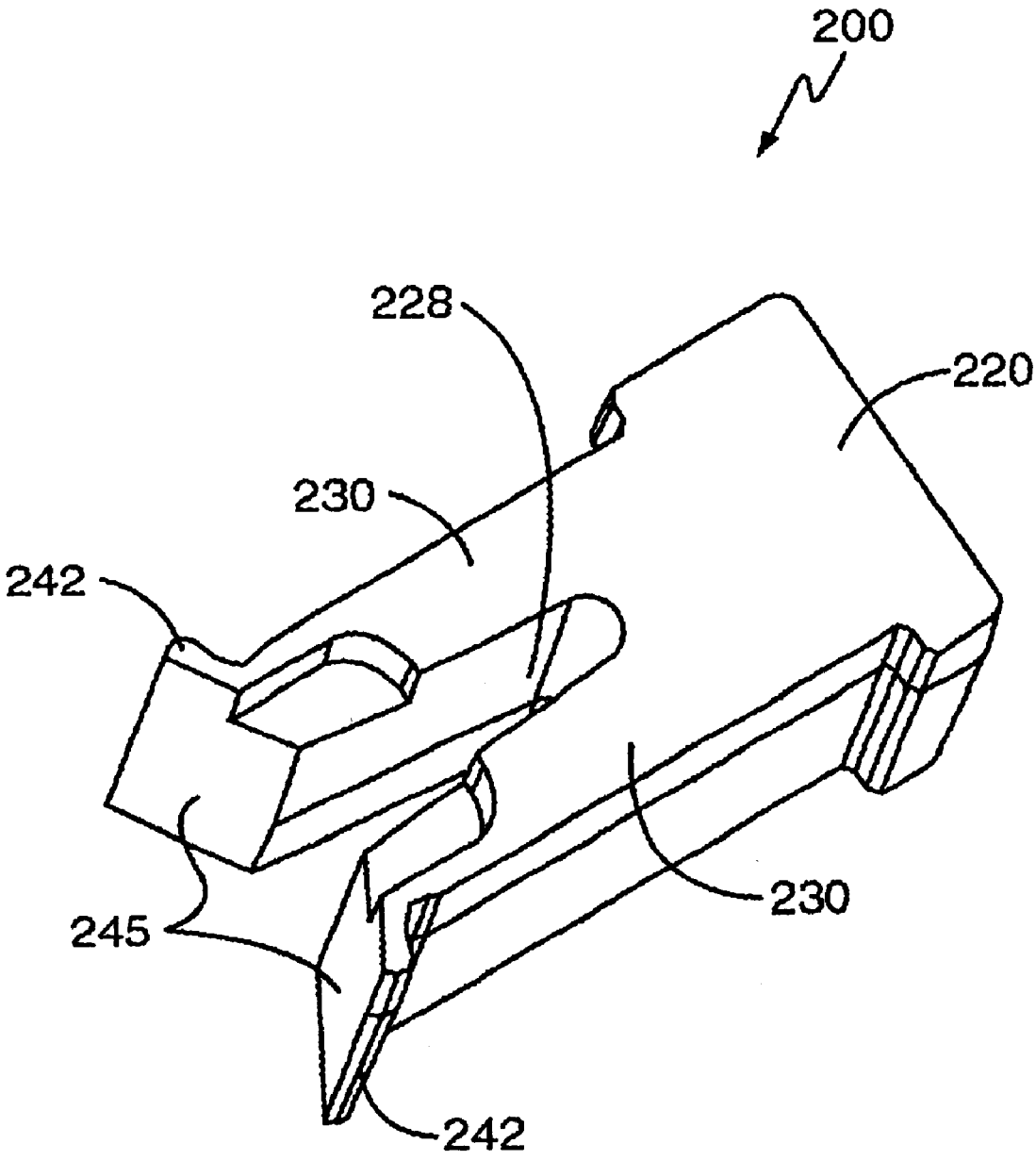
FIG. 5 is a perspective view of an alternative embodiment of a latch mechanism of the present invention.

FIG. 5 illustrates one alternative design having a base 220 with outwardly extending arms 230 having an opening 228 therebetween. The insertion end includes substantially linear jaws 245 with extension wings 242. This embodiment does not feature a minimized channel entry 49 or jaws 45 as that disclosed in the embodiment of FIG. 1. The spacing of the arms 230 provides for positioning between an opening position as illustrated in FIG. 5 with the arms 230 spaced a distance apart with opening 228 between, and a closed position in which the arms 230 contact or are in proximity with a reduced opening.

Figure 6:
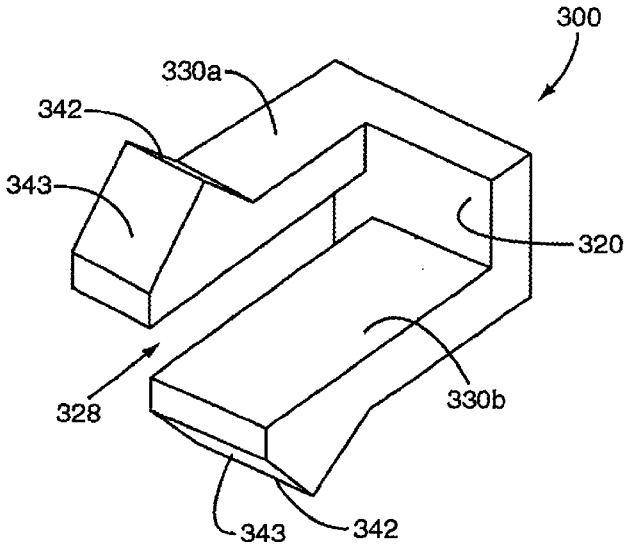
FIG. 6 is a perspective view of an alternative embodiment of a latch mechanism.

FIG. 6 illustrates a latch mechanism 300 having arms 330*a*, 330*b* extending from the base 320 in offset vertical and horizontal planes. A first arm 330*a* is positioned along a first horizontal base edge and a second arm 330*b* is positioned along a second horizontal base edge. Additionally, the first arm 330*a* is positioned along a first vertical base edge and the second arm 330*b* is positioned along a second vertical base edge. An opening 328 is formed between the arms 330 in the open orientation. Retention barbs 342 extend outward from each of the arms and includes lead-in edges 343 for insertion into the receptacle 100.

Figure 7A:
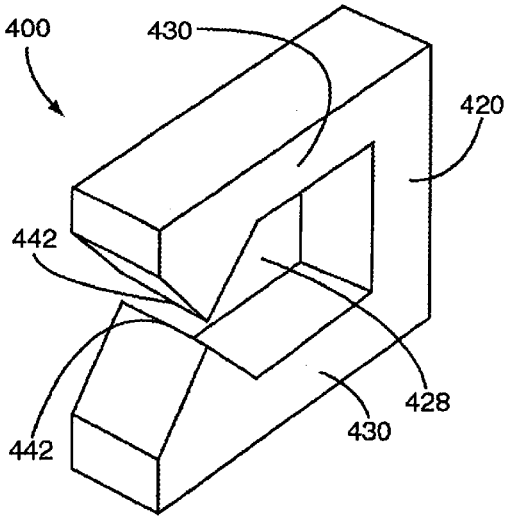
FIG. 7A is a perspective view of an another alternative embodiment of a latch mechanism.
Figure 7B:
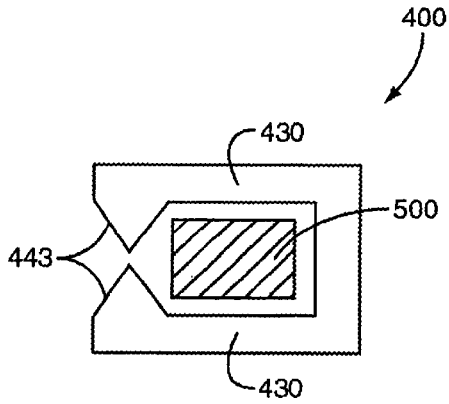
FIG. 7B is a side view illustrating the latch mechanism of FIG. 7A in the closed position extending around an object.

FIGS. 7A and 7B illustrate another alternative embodiment in which the latch mechanism 400 attaches about an object 500, such as a lateral bar disposed in the opening 102 of receptacle 100, for maintaining proper positioning of the connector 90. The mechanism 400 includes a base 420 and arms 430 extending therefrom. A jaw 442 with a lead-in angle 443 extends inward from each arm 430. An opening 428 formed between the arms 430 is sized for containing the object 500. In a closed orientation as illustrated in FIGS. 7A and 7B, the jaws 442 are positioned proximate to each other. The open orientation is obtained by forcing the lead-in angles 443 against the object 500 such that the arms 430 are forced apart a distance for the object 500 to fit into the opening 428. Once the object is within the opening 428, the arms 430 return to the closed position as illustrated in FIG. 7B. Preferably, the jaws 442 have the same width as the arms 430.

The present invention may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A passive male cantilever latch mechanism, comprising:

a base;

a first arm having a fixed end proximate said base and a moveable jaw end distal from said base and extending in a cantilevered fashion from said base, said first arm including a barb on a exterior portion thereof proximate said jaw end;

a second arm having a fixed end proximate said base and a moveable jaw end distal from said base and extending in a cantilevered fashion from said base, said second arm independently moveable with respect to said jaw end of said first arm, said second arm further including a barb on a exterior portion thereof proximate said jaw end;

said jaw ends of said first and second arms moveable between an open configuration wherein said jaw ends are spaced apart and a closed configuration wherein said jaw ends are in closer proximity.

2. The mechanism of claim 1, wherein said first and second arms have widths generally tapering from said respective fixed ends to said respective jaw ends.

3. The mechanism of claim 1, wherein said first and second arms are disposed generally parallel to one another so as to form a generally U-shaped body with said base in said open configuration.

4. The mechanism of claim 1, further including a cavity generally defined by said base and said first and second arms and wherein said jaw ends define a channel opening into said cavity in said open configuration, but close off said passage in said closed configuration.

* * * * *